US007281567B2

(12) United States Patent
Hohenbichler et al.

(10) Patent No.: US 7,281,567 B2
(45) Date of Patent: Oct. 16, 2007

(54) CASTING ROLL AND A METHOD FOR PRODUCING A CASTING ROLL

(75) Inventors: Gerald Hohenbichler, Kronstorf (AT); Gerald Eckerstorfer, Linz (AT); Thomas Reiter, Gmunden (AT); Jean-Michel Damasse, Rueil Malmaison (FR)

(73) Assignee: Voest-Alpine Industrieanlagenbau, GmbH & Co. (AT)

( * ) Notice: Subject to any disclaimer, the term of this patent is extended or adjusted under 35 U.S.C. 154(b) by 122 days.

(21) Appl. No.: 10/501,293

(22) PCT Filed: Dec. 18, 2002

(86) PCT No.: PCT/EP02/14468

§ 371 (c)(1),
(2), (4) Date: Oct. 22, 2004

(87) PCT Pub. No.: WO03/057390

PCT Pub. Date: Jul. 17, 2003

(65) Prior Publication Data

US 2005/0039875 A1 Feb. 24, 2005

(30) Foreign Application Priority Data

Jan. 11, 2002 (AT) ..... A 47/2002

(51) Int. Cl.
*B22D 11/128* (2006.01)

(52) U.S. Cl. ..... 164/448; 164/442

(58) Field of Classification Search ..... 164/418, 164/448, 442

See application file for complete search history.

(56) References Cited

U.S. PATENT DOCUMENTS

| | | | | |
|---|---|---|---|---|
| 3,135,319 | A | 6/1964 | Richards | |
| 4,773,468 | A | 9/1988 | Lauener | |
| 5,191,925 | A | 3/1993 | Sosin | |
| 5,209,283 | A * | 5/1993 | Miltzow et al. | 164/448 |
| 5,823,926 | A * | 10/1998 | Hartz | 492/1 |

FOREIGN PATENT DOCUMENTS

| | | |
|---|---|---|
| DE | 40 27 225 | 2/1992 |
| DE | 197 05 796 | 8/1997 |
| DE | 41 30 202 | 3/2002 |
| EP | 0 246 188 | 11/1987 |
| JP | 55 165262 | 12/1980 |
| JP | 56 017 169 | 2/1981 |

OTHER PUBLICATIONS

International Search Report dated Oct. 13, 2003.
U.S. Patent 5 887 644, English language equivalent of—DE 197 05 796.

* cited by examiner

*Primary Examiner*—Len Tran
(74) *Attorney, Agent, or Firm*—Ostrolenk, Faber, Gerb & Soffen, LLP

(57) ABSTRACT

A casting roll for the continuous casting of thin metal strips, in particular steel strips in a double-roll or roll-in installation. The roll comprises a roll core with an external casing and an annular roll jacket with an internal casing. The jacket surrounds the core and is being shrunk onto the latter. To prevent migratory motion of the roll jacket in relation to the roll core, the surface of at least one of the opposing casings that form a shrinkage connection has protuberances and indentations, which are oriented at least partially in the direction of the casting roll axis and extend radially for at least 2 μm.

47 Claims, 1 Drawing Sheet

CASTING ROLL AND A METHOD FOR PRODUCING A CASTING ROLL

BACKGROUND OF THE INVENTION

The invention relates to a casting roll for the continuous casting of thin metallic strips, in particular of steel strips, in a two-roll or one-roll casting installation. The casting roll has a roll core with an outer lateral surface and an annular roll shell which surrounds the roll core, is shrunk on and has an inner lateral surface and having a central casting-roll axis, and to a process for producing a casting roll of this type.

Casting rolls of this type are used to produce metal strip with a thickness of up to 10 mm. Liquid metal is applied to the surface of at least one casting roll, where it at least partially solidifies and is deformed into the desired strip format. If the metal melt is applied predominantly to a casting roll, one speaks of one-roll casting processes. If the metal melt is introduced into a casting nip which is formed by two casting rolls arranged at a distance from one another, with the metal melt solidifying at the two casting-roll surfaces and a metal strip being formed therefrom, one speaks of two-roll casting processes. In these production processes, large quantities of heat have to be dissipated from the casting roll surface into the interior of the casting roll within a short time. This is achieved by the casting roll being equipped with an outer roll shell made from a particularly thermally conductive material, preferably copper or a copper alloy, and internal cooling with a cooling-water circuit. Casting rolls of this type have already been described, for example in U.S. Pat. No. 5,191,925 or DE-C 41 30 202.

U.S. Pat. No. 5,191,925 has disclosed a casting roll in which two annular roll shells are drawn onto a roll core equipped with cooling ducts, and the two roll shells are joined to one another by a welded joint, or one roll shell is produced by electrodeposition on the other roll shell.

DE-C 41 30 202 has disclosed a casting roll in which a join is produced between a roll core and a roll shell by brazing, with a suitable brazing solder, preferably in the form of a strip of this brazing solder, having to be applied and secured between the roll core and the roll shell prior to assembly. The roll shell is drawn onto the roll core by means of a thermal shrinking process and in this way a provisional join is formed, followed by the more time-consuming brazing process.

In conventional continuous-casting installations, it is known for the continuous-casting mold to be followed, over the path of the strand, by supporting and guide rollers, which are subject to significantly lower thermal loads, for supporting the cast strand (DE-C 40 27 225). In the case of these supporting and guide rollers, a roller shell is drawn onto a roller core by means of a shrink-fit connection, with a mating fit which complies with the appropriate standards then being provided between the roller shell and roller core.

On account of the high productivity required of the installation, extreme cyclical thermal loads are produced at the roll shell of casting rolls for the direct casting of metal strips, in particular when steel is being cast. It is known that a specific dissipation of heat of up to 15 $MW/m^2$ and more has to be effected through the roll shell. In casting roll structures of the type described in the introduction, which are usually formed by a copper tube shrunk onto a steel core, the local, cyclically occurring circumferential stress fluctuations associated with the thermal loads give rise to circumferential forces which can cause the copper shell to migrate on the steel core. This migrating movement leads to changes in adhesion at the contact surface between copper shell and steel core, typically leading to rapid aging of the bonded joint. As a result, the service life of the copper shell or the bonded joint is significantly reduced.

Even the proposed brazed joint, in addition to being complex to produce, is unsuitable for preventing a migratory movement of the roll shell of this type in the long term under the locally high thermal loads which occur.

SUMMARY OF THE INVENTION

Therefore, the object of the present invention is to avoid these described drawbacks of the prior art and to propose a casting roll and a process for producing a casting roll of this type, having a join between roll shell and roll core which withstands the high thermal and mechanical loads while preventing migratory movements of the roll shell on the roll core for a prolonged period of time.

In a casting roll of the type described in the introduction, this object is achieved by virtue of the fact that at least one of the lateral surfaces which lie opposite one another and form a shrink connection has elevations and depressions in the lateral surface, at least some of which are oriented in the direction of the casting-roll axis and the radial extent of which is at least 2 μm. The elevations and depressions on the lateral surface form supporting surfaces which are predominantly oriented substantially parallel to the casting-roll axis and, having a minimum radial extent, produce an additional resistance to a migratory movement of the roll shell with respect to the roll core in the circumferential direction. With a stochastic distribution of these supporting surfaces, their radial extent corresponds to a defined roughness $R_z$ of 2 μm.

A stable join between roll core and roll shell is achieved if the elevations and depressions form a surface structure on at least one of the lateral surfaces which lie opposite one another, in which surface structure the lateral surface has a roughness $R_z$ of between 2 μm and 1500 μm, preferably between 10 μm and 500 μm. With this level of roughness, it is possible to achieve optimum penetration of the elevations into the opposite lateral surface while the shrink connection is being produced, so that a sufficiently large overall supporting surface formed by the individual supporting surfaces counteracts rotation of the shell.

To prevent a migratory movement of the roll shell in the direction of the casting-roll axis and to ensure full centering of the roll shell on the roll core, at least one of the lateral surfaces which lie opposite one another has elevations and depressions in and directly around a casting-roll plane of symmetry which is normal to the axis, substantially along the entire circumference of one of the two lateral surfaces, with a radial extent of at least 2 μm, preferably at least 0.2 mm, in particular 1 to 15 mm, which are preferably oriented in the circumferential direction. As an alternative, these elevations and depressions in and directly around a casting-roll plane of symmetry which is normal to the axis, on at least one of the lateral surfaces which lie opposite one another, form a surface structure in which the lateral surface has a roughness $R_z$ of between 2 μm and 1500 μm.

This effect is achieved optimally if the elevations and depressions form supporting surfaces which are directed substantially radially and in the direction of the casting-roll axis and have a longitudinal extent less than or equal to the lateral-surface length. Supporting surfaces oriented in this manner are produced, for example, if the lateral surface is machined in the direction of the casting-roll axis, for example by knurling. The approximately V-shaped groove formation which is thereby established on a lateral surface results in a fixed join to the further lateral surface if the distance between the groove peaks is preferably between 0.1 and 1.7 mm and the distance between peak and valley is between 0.06 and 0.8.

Furthermore, it has proven expedient if the roll core and the annular roll shell, in the region of the lateral surfaces which lie opposite one another, are formed from materials of different hardness, and at least the lateral surface of the component which has the higher lateral surface hardness is provided with the predetermined roughness. While the roll shell is being shrink-fitted onto the roll core, the roughness pattern of the harder lateral surface stamps itself into the softer lateral surface, resulting in a full-surface positive microlock, which is far superior to the frictional lock which can be achieved during the standard shrink-fitting operation. A difference in hardness between the edge layers in the region of the harder and softer lateral surfaces should amount to at least 20%, but preferably more than 50%, in which context the hardness of the softer lateral surface should be less than 220 HB, preferably less than 150 HB.

As with the described casting rolls of the prior art, it has proven appropriate for the roll core to be made from steel and the annular roll shell to be made from copper or a copper alloy. Forming the roll core from steel provides the casting roll structure with the required operating strength, and forming the roll shell from copper or a copper alloy is imperative for sufficient heat to be dissipated from the metal melt applied thereto.

To enable the shrink fit to be designed for optimum bonding irrespective of the materials selected for the roll core and the roll shell, as well as other influences, it is preferable for a joining layer to be arranged between the roll core and the roll shell, and for the material which forms the joining layer to be deposited on one of the two mutually associated lateral surfaces. In this case, one of the mutually associated lateral surfaces is provided with the predetermined roughness or surface structuring, while the material which forms the joining layer is deposited on the other lateral surface. It is preferable for the joining layer to consist of a metal or a metal alloy, and wear-resistant granules may be embedded in this joining layer. These wear-resistant granules comprise grains or platelets of metal oxides, such as aluminum oxide, zirconium oxide or similar materials or mixtures thereof. The granules may consist of grains or platelets of carbides, such as titanium carbide, tungsten carbide, silicon carbide or similar materials with comparable properties or mixtures thereof. Mixtures of metal oxides and carbides are also expedient. The metal oxides and carbides with a high hardness embedded in a basic matrix additionally reinforce the interlocking between the lateral surfaces. The joining layer may also be formed by a very hard material, for example a plasma ceramic, in which case this material has to be applied to one of the lateral surfaces in such a way that the desired roughness is also established at the same time. The joining layer preferably has a layer thickness of from 0.05 to 1.2 mm. The wear-resistant granules embedded therein have a grain size of less than 40 μm, preferably less than 10 μm.

One further embodiment of the casting roll according to the invention consists in the roll core, parallel to the casting-roll axis, having grooves distributed over its lateral surface, into which grooves securing bars are fitted, which project at least 2 μm above the lateral surface of the roll core in the radial direction. The securing bars projecting above the lateral surface of the roll core are pressed into the lateral surface of the roll shell during the shrink connection and themselves form a supporting surface preventing the shell from rotating, and also, by virtue of being stamped into the roll shell, produce an oppositely directed supporting surface therein. It is preferable for these securing bars to project no more than 1500 μm above the lateral surface of the roll core, since the extent to which they can be stamped into the roll shell is limited. If flush contact between the two lateral surfaces cannot be achieved solely by the securing bars being pressed into the roll shell, it is preferably also possible to mill shallow indentations of low depth in the roll shell at the locations located opposite the grooves in the roll core.

According to a further embodiment, the securing bars project between 500 μm and 15 mm above the lateral surface of the roll core in the radial direction. In this case, grooves are also milled into the inner lateral surface of the roll shell, these grooves lying opposite the grooves in the lateral surface of the roll core, with grooves lying opposite one another in each case accommodating one securing bar. The flanks of the securing bar and the flanks of the grooves form corresponding supporting surfaces oriented in the direction of the casting-roll axis. A large-area shrink connection between the roll core and the roll shell is additionally possible if the sum of the depth of two grooves is greater than the height of the securing bar which they accommodate.

Typical groove depths in the roll core are from 2 to 15 mm and in the roll shell are from 0.4 to 5 mm. The width of the securing bar is between 4 and 45 mm, preferably between 5 and 25 mm. It is customary for fewer than 16, preferably fewer than 8 securing bars and grooves to be distributed over the circumference of the roll core, preferably at regular intervals. At least 3 grooves are required to sufficiently protect against rotation of the roll shell if, at the same time, an uneven distribution of forces and stresses in the roll shell is to be avoided. The length of the grooves and securing bars is shorter than the lateral surface length of the roll core. This avoids the risk of the securing bars slipping out under operating load.

A process for producing a casting roll which is suitable for the continuous casting of thin metallic strips, in particular of steel strips, using the two-roll or one-roll casting process, which casting roll substantially comprises a roll core with an outer lateral surface and an annular roll shell which surrounds the roll core, has been shrunk on and has an inner lateral surface and a central casting-roll axis, is characterized in that the lateral surface of the roll core and the inner lateral surface of the roll shell are prepared for joining by shrink-fitting, in that elevations and depressions, at least some of which are oriented in the direction of the casting-roll axis and the radial extent of which is at least 2 μm, are produced on at least one of the mutually associated lateral surfaces which form a shrink connection, and in that the roll shell is drawn onto the roll core at a temperature which is higher than that of the roll core. This is then followed by controlled cooling of the casting roll to room temperature.

The preparations for forming a shrink connection substantially comprise a mating fit which is matched to the operating conditions of the casting roll being selected and the roll core being produced with a corresponding external diameter and the roll shell with a corresponding internal diameter. The measure which is crucial according to the invention in this context involves the formation of one of the two interacting lateral surfaces with a surface structure in which elevations and depressions form supporting surfaces which are predominantly oriented substantially parallel to the casting-roll axis and which have a minimum radial extent in order to ensure a suitable resistance to a migratory movement of the roll shell in the circumferential direction. It is preferable for an oriented surface structure which has a roughness $R_z$ of between 2 μm and 1500 μm, preferably between 10 μm and 500 μm, to be machined into the lateral surface. In this context, it has proven particularly expedient to form a surface structure in which the elevations and depressions which are machined into at least one of the mutually associated lateral surfaces are produced with supporting surfaces which are directed substantially radially and in the direction of the casting-roll axis and have a longitudinal extent less than or equal to the lateral-surface length.

During production of the shrink connection, the oriented surface structure machined into one of the lateral surfaces penetrates into the surface of the opposite lateral surface with a greatly reduced likelihood of flats being formed if the roll core and the annular roll shell are produced from materials of different hardness, and the component which is formed with a higher lateral-surface hardness is provided with the predetermined roughness $R_z$. The hardness of the component formed with a higher lateral-surface hardness can additionally be increased by hardening, nitriding, carburization or a similar process. This makes it possible to substantially dispense with the need for an additional coating, which improves the bonding, on one of the mutually associated lateral surfaces.

The oriented surface structure or the roughness $R_z$ is produced in a simple way by machining of the lateral surface, for example by knurling, forging or milling. In particular in the case of forging or milling in the direction of the casting-roll axis, it is easy to produce a correspondingly oriented surface structure with a predetermined roughness, which has supporting surfaces that are oriented predominantly in the direction of the casting-roll axis and counteract rotation of the shell.

The bond between the roll core and the roll shell can be additionally improved if a joining layer is deposited on one of the mutually associated lateral surfaces, with the predetermined roughness advantageously being applied to one lateral surface and the joining layer being deposited on the other lateral surface in a layer thickness of from 0.05 to 1.2 mm. The joining layer, formed from a metal or a metal alloy, is preferably applied to the lateral surface by electrodeposition or plasma deposition. In addition, it is also possible for the granules which have already been described above to be incorporated in the joining layer.

A variant on the described process for producing a casting roll with a correspondingly stable rotation-preventing measure between roll core and roll shell, is produced by virtue of the lateral surface of the roll core and the inner lateral surface of the roll shell being prepared for joining by shrink-fitting, by grooves being formed on the lateral surface of the roll core parallel to the casting-roll axis, into which grooves securing bars are fitted which project at least 2 μm, preferably between 500 μm and 15 mm, above the lateral surface of the roll core in the radial direction, and by the roll shell being drawn onto the roll core at a temperature which is higher than that of the roll core, a shrink-fit connection being produced between the securing bars and the roll shell and at least one sealed join being produced between the roll core and the roll shell. This is then followed by controlled cooling of the casting roll to room temperature.

BRIEF DESCRIPTION OF THE DRAWING

Further advantages and features of the invention will emerge from the following description of non-limiting exemplary embodiments, in which reference is made to the appended figures, in which.

DESCRIPTION OF PREFERRED EMBODIMENTS

Figure 1:
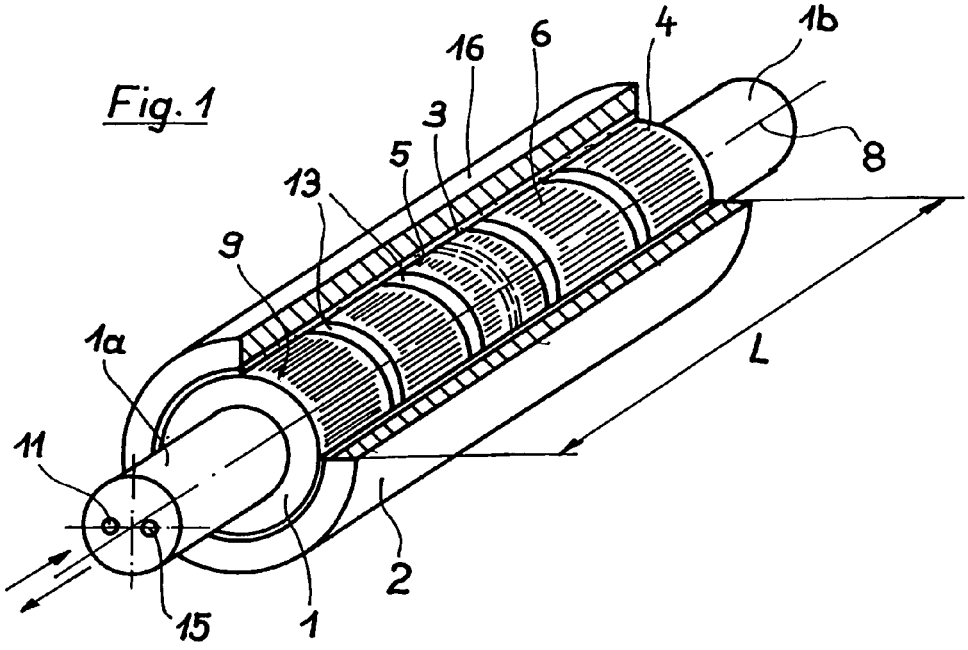
FIG. 1 shows a partial section through a casting roll with the lateral surface of the roll core formed in accordance with a first embodiment of the invention.

FIG. 1 diagrammatically depicts a partial section through a casting roll according to the invention for the continuous casting of steel strips in a two-roll continuous-casting installation. It comprises a roll core 1 made from steel, which ends in roll journals 1*a*, 1*b* for providing support in casting-roll bearings (not shown). A cylindrical roll shell 2 made from a copper alloy surrounds the roll core 1 and is secured to the latter in a manner fixed against rotation by means of a shrink connection 3. The shrink connection 3 is formed by the outer lateral surface 4 of the roll core 2 and the inner lateral surface 5 of the roll shell 2, with the two lateral surfaces 4 and 5, by means of a directional surface structure, producing an increased resistance against rotation compared to conventional shrink connections. By way of example, it is illustrated in FIG. 1 that the lateral surface 4 is equipped with knurling 6, with the grooves 7 produced by the knurling being oriented in the direction of the casting-roll axis 8 and forming V-shaped supporting surfaces 9, which extend substantially radially and in the direction of the casting-roll axis 8 and in large numbers act as surfaces which resist rotation of the roll shell 2 relative to the roll core 1. A metallic joining layer 10 is deposited, for example electrolytically, on the inner lateral surface 5 of the roll shell 2 and forms a relatively soft layer with a low hardness, into which the structured outer lateral surface 4 of the roll core 1 penetrates during production of the shrink connection, without significantly changing its structure. In addition, granules formed by various metal oxides or carbides may be embedded in the joining layer, thereby additionally increasing the bonding action.

The casting roll is provided with an inner circulating liquid cooling system, in which cooling liquid is fed via a central feed line 11 and radial branch lines 12 to annular coolant ducts 13 which have been milled into the outer lateral surface 4 of the roll core 1 and is discharged again via further radial branch lines 14 and a central discharge line 15. Heat is extracted from the steel melt applied to the casting roll surface 16 by means of the coolant circulating through the milled coolant ducts 13, and this heat is dissipated into the coolant through the roll shell 2.

Figure 2:
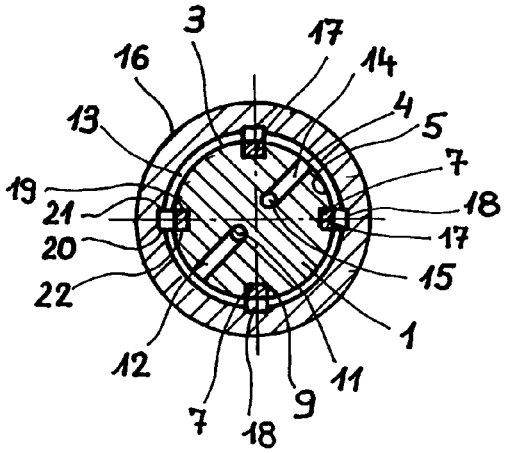
FIG. 2 shows a cross section through a casting roll with the lateral surfaces formed in accordance with a second embodiment of the invention.

FIG. 2 illustrates a cross section through the casting roll with a shrink connection 3 in accordance with a further embodiment of the invention. The roll core 1, as in FIG. 1, is equipped with a coolant circuit, which comprises a central feed line 11, radial branch lines 12, radial branch lines 14 and a central discharge line 15. In the embodiment illustrated in FIG. 2, the annular coolant ducts 13 are turned into the roll shell 2. Parallel to the casting-roll axis 8, four grooves 7 are milled into the outer lateral surface 4 of the roll core 1, and a securing bar 17, which projects a short distance above the outer lateral surface 4 of the roll core 1, is inserted into each of these grooves 7. In the same way, grooves 18 of low depth, which are located opposite the grooves 7 in the roll core 1 and together accommodate the securing bars 17, are milled into the inner lateral surface 5 of the roll shell 2.

The lateral flanks 19, 20 of the securing bars 17 and the lateral flanks 21, 22 of the grooves 7, 18 milled into the circumferential cooling fins in the roll core 1 and in the roll shell 2 (in the region of the circumferentially running cooling fins 24) in this case act as supporting surfaces preventing the shell from rotating.

Figure 3:
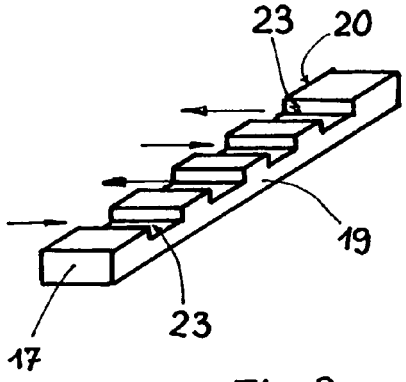
FIG. 3 shows a perspective, outline view of the securing bars used in FIG. 2.

FIG. 3 shows a perspective view of the securing bar 17. The securing bar 17 includes recesses 23 for the coolant to pass through without disruption, these recesses 23 being flush with the annular coolant ducts 13 in the fitted position of the securing bar. Recesses 23 arranged next to and at a distance from one another have coolant flowing through them, in each case preferably in opposite directions, in order to ensure uniform roll shell cooling. This is indicated by arrows.

The scope of protection of the casting roll is not restricted to the embodiments which have been explained in detail, but rather also encompasses in particular casting rolls with a roll shell having substantially centrally located axial cooling bores, and casting rolls with trapezoidal-thread-like cooling ducts machined into the roll core or the roll shell, or casting rolls with circumferential cooling fins machined into the roll core.

The invention claimed is:

1. A casting roll for the continuous casting of thin metallic strips, in a roll casting installation, the roll comprising:

a roll core having an outer lateral surface:

an annular roll shell which surrounds the roll core and includes an inner lateral surface opposite the outer lateral surface of the core, wherein:

the roll shell is shrunk onto the roll core so that the outer surface of the roll core and the inner surface of the roll shell are in contact substantially over the respective entire surfaces;

at least one of the lateral surfaces has elevations and depressions forming a surface structure thereon having a roughness ($R_z$) on the surface of between about 2 μm and about 1500 μm; and at least some of the elevations and depressions are oriented in the direction of a rotational axis of the casting-roll.

2. The casting roll as claimed in claim 1, wherein the roughness ($R_z$) is between 10 μm and 500 μm.

3. The casting roll as claimed in claim 1, wherein:

the elevations and depressions are in and directly around a casting-roll plane of symmetry which is normal to the rotational axis and is substantially along the entire circumference of one of the lateral surfaces with a radial extent of between about 2 μm and about 1500 μm; and the elevations and depressions are oriented in the circumferential direction.

4. The casting roll as claimed in claim 1, wherein the elevations and depressions form supporting surfaces which are directed substantially radially and in the direction of the casting-roll axis and have a longitudinal extent less than or equal to the lateral-surface length (L).

5. The casting roll as claimed in claim 1, wherein:

in the region of the lateral surfaces which lie opposite one another, the roll core and the annular roll shell are formed from materials of different hardness, and at least the lateral surface of the core or the shell which has the higher lateral surface hardness is provided with the roughness ($R_z$).

6. The casting roll as claimed in claim 1, wherein the roll core is comprised of steel and the annular roll shell is comprised of Cu or a Cu alloy.

7. The casting roll as claimed claim 1, further comprising a joining layer arranged between the roll core and the roll shell.

8. The casting roll as claimed in claim 7, wherein the material which forms the joining layer is deposited on a lateral surface which does not have the roughness ($R_z$).

9. The casting roll as claimed in claim 8, wherein the joining layer is comprised of a metal or a metal alloy.

10. The casting roll as claimed in claim 7, further comprising wear-resistant granules embedded in the joining layer.

11. The casting roll as claimed in claim 10, wherein the wear-resistant granules are comprised of metal oxides.

12. The casting roll as claimed in claim 10, wherein the wear-resistant granules are comprised of carbide grains or platelets.

13. The casting roll as claimed in claim 10, wherein the wear-resistant granules have a grain size less than 40 μm.

14. The casting roll as claimed in claim 1, wherein the surface structure is formed by:

grooves distributed over the outer lateral surface of the roll core and parallel to the casting-roll axis; and securing bars fitted into the grooves, the bars projecting between about 2 μm and about 1500 μm above the lateral surface of the roll core in the radial direction; and the securing bars are pressed into the lateral surface of the roll shell when the roll shell is shrink fitted onto the roll core.

15. The casting roll as claimed in claim 14, wherein:

the securing bars project between 500 μm and 15 mm above the lateral surface of the roll core in the radial direction; and the inner lateral surface of the roll shell includes second grooves which lie opposite the grooves in the lateral surface of the roll core and respective grooves in the opposite lateral surfaces lie opposite one another and the respective grooves opposite one another accommodate one of the securing bars.

16. The casting roll as claimed in claim 14 wherein fewer than 16 of the securing bars and grooves are distributed over the roll core.

17. The casting roll as claimed in claim 14, wherein the grooves and the securing bars have a length along the axis that is shorter than a lateral-surface length of the roll core.

18. The casting roll as claimed in claim 7, wherein the joining layer is deposited on one of the two lateral surfaces.

19. The casting roll as claimed in claim 7, wherein the joining layer is comprised of a metal or a metal alloy.

20. The casting roll as claimed in claim 11, wherein the metal oxides comprise aluminum oxide or zirconium oxide.

21. The casting roll as claimed in claim 12, wherein the carbide comprises titanium carbide, tungsten carbide or silicon carbide.

22. The casting roll as claimed in claim 10, wherein the wear-resistant granules have a grain size less than 10 μm.

23. The casting roll as claimed in claim 14, wherein fewer than eight of the securing bars and grooves are distributed over the roll core.

24. The casting roll as claimed in claim 15, wherein the sum of the depths of the two respective grooves is greater than the height of the securing bar which they accommodate.

25. A process for producing a casting roll for the continuous casting of thin metallic strips, using a roll casting process, wherein the casting roll is comprised of a roll core with an outer lateral surface and an annular roll shell which surrounds the roll core and has an inner lateral surface adjacent to the outer surface of the roll core, and is further comprised of a central rotational axis, the method comprising the steps of:

preparing at least one of the adjacent surfaces by forming radially extending elevations or depressions thereon, at least some of which are oriented in the direction of the casting-roll axis, to define a surface structure characterized by a roughness (Rz) of between about 2 μm and about 1500 μm, then drawing the roll shell onto the roll core so that the outer and inner lateral surfaces oppose each other, while holding the roll shell at a temperature which is higher than the temperature of the roll core.

26. The process as claimed in claim 25 further comprising, producing the elevations or depressions to define a surface structure in which the at least one lateral surface has a roughness ($R_z$) of between 10 μm and 500 μm.

27. The process as claimed in claim 25, wherein the elevations or depressions are formed to have supporting surfaces which are directed substantially radially and have a longitudinal extent in the direction of the casting-roll axis which is less than or equal to a lateral-surface length in the direction of the axis.

28. The process as claimed in claim 25, further comprising producing the roll core and the annular roll shell from respective materials of different hardness at least at the respective lateral surfaces, and forming the predetermined roughness (Rz) on the one of the roll core and the roll shell having the higher lateral-surface hardness.

29. The process as claimed in claim 28, further comprising applying the roughness by knurling, forging or milling the respective lateral surface.

30. The process as claimed in claim 25, wherein the roll core at least at the outer lateral surface is of steel and the annular roll shell at least at the inner lateral surface is of Cu or a Cu alloy.

31. The process as claimed in claim 25, further comprising depositing a joining layer on one of the opposing lateral surfaces.

32. The process as claimed in claim 25, wherein the predetermined roughness ($R_z$) is applied to one of the lateral surfaces and the method further comprises the step of depositing a joining layer on the other lateral surface.

33. The process as claimed in claim 31, wherein the joining layer is deposited by electrodeposition.

34. The process as claimed in claim 31, wherein the joining layer is deposited by plasma deposition.

35. The process as claimed in claim 31, wherein the joining layer is comprised of a metal or a metal alloy.

36. The process as claimed in claim 31, further comprising incorporating wear-resistant granules in the joining layer.

37. The process as claimed in claim 36, further comprising the step of incorporating metal oxides in the joining layer as the wear-resistant granules.

38. The process as claimed in claim 36, further comprising the step of incorporating carbide grains or carbide platelets in the joining layer as the wear-resistant granules.

39. The process as claimed in claim 36, wherein the wear-resistant granules have a grain size of less than 40 μm.

40. A process as claimed in claim 25, further comprising permitting the roll shell to cool after being drawn onto the roll core, so that the roll shell is shrink fitted on the roll core, with the lateral surfaces in a substantially flush relationship.

41. The process as claimed in claim 30, wherein the roughness is formed on the outer lateral surface.

42. A process as claimed in claim 37, wherein the metal oxides comprise aluminum oxide or zirconium oxide.

43. A process as claimed in claim 38, wherein the carbide comprises titanium carbide, tungsten carbide or silicon carbide.

44. A process as claimed in claim 36, wherein the wear-resistant granules have a grain size of less than 10 μm.

45. A process for producing a casting roll for the continuous casting of thin metallic strips, in a roll casting process, wherein the casting roll has a roll core with an outer lateral surface and an annular roll shell which surrounds the roll core and has an inner lateral surface and the roll has a central casting-roll axis, the method comprising the steps of:

preparing at least one of the lateral surfaces of the roll core and the roll shell for joining by shrink-fitting by forming grooves on the outer lateral surface of the roll core to extend parallel to the casting-roll axis;

fitting securing bars into the grooves wherein the grooves and the bars therein are so sized and shaped that the bars project above the outer lateral surface of the roll core in the radial direction;

then drawing the roll shell onto the roll core while holding the roll shell at a temperature which is higher than that of the roll core for producing a shrink-fit connection between the securing bars and the roll shell such that the securing bars are pressed into the inner lateral surface of the roll shell sufficiently that the lateral surfaces are substantially flush with each other; and producing at least one sealed join between the roll core and the roll shell.

46. A process as claimed in claim 45, further comprising permitting the roll shell to cool after being drawn onto the roll core, so that the roll shell is shrink fitted on the roll core.

47. A process as claimed in claim 45, wherein the grooves and the bars therein are so sized and shaped that the bars project between 500 μm and 15 mm above the outer lateral surface.

* * * * *